United States Patent [19]

Minarczyk

[11] 4,322,658

[45] Mar. 30, 1982

[54] HIGH INTENSITY DISCHARGE LAMP CONTAINING ELECTRONIC STARTING AID

[75] Inventor: Michael M. Minarczyk, North Royalton, Ohio

[73] Assignee: General Electric Company, Schenectady, N.Y.

[21] Appl. No.: 131,608

[22] Filed: Mar. 19, 1980

[51] Int. Cl.[3] ..... H01J 7/44; H01J 17/34; H01J 19/78; H01K 1/62

[52] U.S. Cl. ..... 315/47; 315/60; 315/74; 315/100; 315/DIG. 7

[58] Field of Search ..... 315/47, 60, 61, 73, 315/74, 100, 234, 240, DIG. 5, DIG. 7

[56] References Cited

U.S. PATENT DOCUMENTS

| | | | |
|---|---|---|---|
| 2,266,662 | 12/1941 | Spanner et al. | 315/60 |
| 3,666,986 | 5/1972 | Lake et al. | 315/49 |
| 3,963,958 | 6/1976 | Nuckolls | 315/276 |
| 4,064,416 | 12/1977 | Krense et al. | 315/60 |
| 4,134,042 | 1/1979 | VanHeemskerck | 315/59 |
| 4,223,247 | 9/1980 | Jacobs et al. | 315/73 |

*Primary Examiner*—Saxfield Chatmon, Jr.
*Attorney, Agent, or Firm*—Ernest W. Legree; Lawrence R. Kempton; Philip L. Schlamp

[57] ABSTRACT

A high intensity discharge lamp comprises a two-electrode arc tube and an external starting probe supported from a base and preferably sealed within an outer envelope to which the base is attached. The base contains an electronic pulsing circuit comprising a capacitor connected in a charging circuit across the base terminals, a pulse transformer having its primary connected in series with a voltage sensitive switch across the capacitor, and a step-up secondary connected to the probe. After starting, the voltage across the capacitor drops below the breakdown level of the switch and pulsing stops.

3 Claims, 2 Drawing Figures

HIGH INTENSITY DISCHARGE LAMP CONTAINING ELECTRONIC STARTING AID

The invention relates to an improved high intensity discharge lamp provided with an electronic starting aid through which the usual need for an auxiliary starting electrode sealed into the arc tube is eliminated. By so doing higher efficacy and better lumen maintenance together with longer life may be achieved.

BACKGROUND OF THE INVENTION

High intensity discharge lamps of the mercury vapor or metal halide types generally comprise a quartz or fused silica arc tube mounted within a glass outer envelope or jacket having a screw base at one end. The arc tube contains the discharge medium such as mercury and metal halide, along with an inert gas such as argon for starting purposes. The arc discharge takes place between thermionic main electrodes which are sealed into the ends of the arc tube. In order to facilitate starting of the lamp, it has been common practice to provide also an auxiliary starting electrode which is sealed into an end of the arc tube adjacent one of the main electrodes. The auxiliary electrode may be a tungsten wire projecting into the arc tube discharge space and connected through a current-limiting resistor to the main electrode remote from it.

A starting electrode is very useful to ease the burden on the ballast in starting the lamp but it has definite drawbacks. Metal halide salt condensed in the region about the starting electrode and the adjacent main electrode may be subjected to electrolysis leading to accelerated failure of the seal at the end of the arc tube having the starting electrode. U.S. Pat. No. 3,226,697—Green, 1965, provides a solution to this problem in the form of a thermal switch arranged to short-circuit the starting electrode to the adjacent main electrode when actuated by heat from the arc tube after the lamp has started and warmed up. While this is a good practical answer which has been widely adopted, it is not perfect. The delay in closing the thermal switch while the arc tube warms up is a definite factor in reducing maintenance and shortening lamp life, particularly in applications where the lamp is turned on and off frequently. Furthermore the starting electrode complicates manufacture and makes a wider seal necessary which it may be desired to avoid.

SUMMARY OF THE INVENTION

The object of the invention is to provide a new and improved high intensity discharge lamp in which the need for an auxiliary starting electrode is eliminated.

A high intensity discharge lamp in accordance with my invention utilizes an arc tube having a main electrode only sealed into each end, no auxiliary starting electrode being provided. The arc tube and an external starting probe are supported from a base, the probe extending into proximity to the discharge chamber of the arc tube. In the usual preferred arrangement, both the arc tube and probe are mounted or enclosed within an outer envelope or jacket which has a neck at one end to which the base is attached. The base contains an electronic pulsing circuit comprising a capacitor included in a charging circuit connected across the base terminals, a pulse transformer and a voltage sensitive switching device. The voltage sensitive switching device is connected in series with the primary of the transformer across the capacitor, and the secondary of the transformer is connected to the probe. The pulse transformer is excited by the energy stored in the capacitor when it discharges through the switching device, and generates a high voltage pulse which is applied to the arc tube through the probe. Upon starting of the arc tube, the voltage applied across the switching device drops below its breakdown voltage, turning off the circuit.

An optional feature of the invention is a thermal switch located within the base and connected in series with the capacitor in the charging circuit. The capacitor is subject to rapid deterioration when left under lamp voltage at the relatively high temperature inside the base. The thermal switch opens after the lamp has been in operation long enough to heat the base, thereby taking the capacitor out of circuit. This assures a long life for the capacitor notwithstanding its location.

DESCRIPTION OF DRAWINGS

In the drawings wherein like reference characters indicate corresponding elements in the several views.

DETAILED DESCRIPTION

Figure 1:
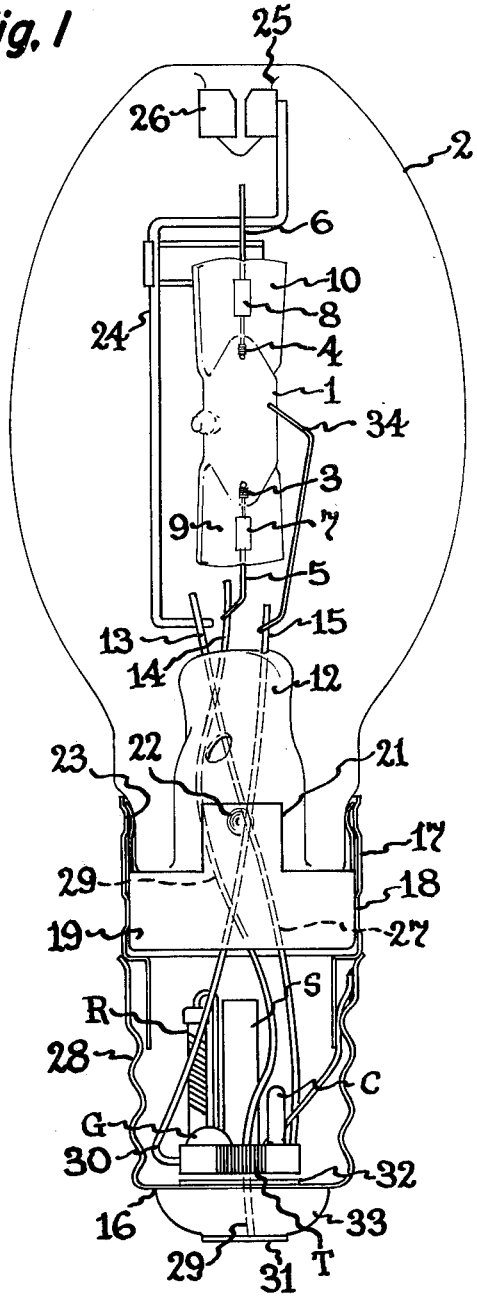
FIG. 1 illustrates a high intensity discharge lamp embodying the invention in preferred form and wherein the base components have been vertically exploded to show the internal arrangement.
Figure 2:
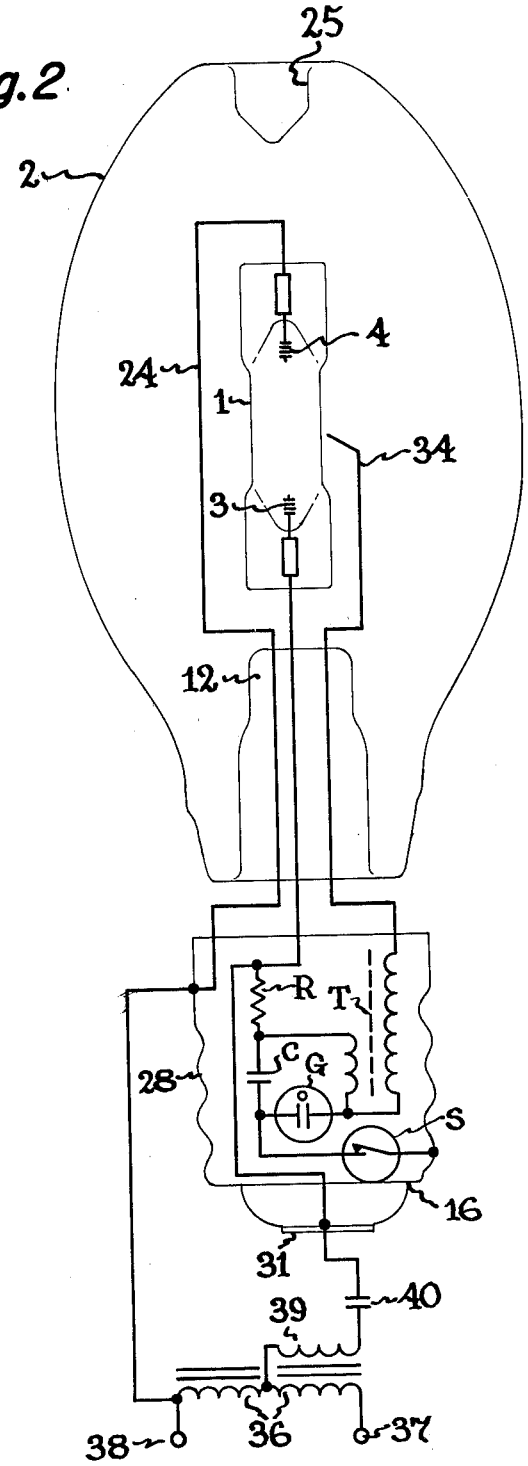
FIG. 2 illustrates schematically the circuit arrangement of the lamp of FIG. 1.

Referring to FIG. 1, there is shown a 175 watt metal halide lamp embodying the invention and comprising an arc chamber defined within an inner envelope or arc tube 1 of fused silica which is supported within an outer glass envelope or jacket 2. Tungsten wire electrodes 3,4 are disposed at the ends of the tube 1 and are supported by current inleads 5,6 respectively which extend by means of molybdenum foils 7,8 in a vacuum tight manner through the pinched ends 9,10 of the tube. By way of example, an arc tube as illustrated has an internal volume of 3.9 cc and a suitable filling comprises 26 mg of mercury and 11 mg of halide salt consisting of 84% NaI, 12% $ScI_3$ and 4% $ThI_4$ by weight plus an inert starting gas such as argon or xenon.

The outer envelope 2 is provided at its lower or neck end with a re-entrant stem 12 through which extend three relatively stiff lead-in wires 13,14 and 15. A mogul screw base 16 is retained on the neck by means of an extension collar 17 which is crimped at 18 to an inner steel shell 19 provided with resilient tabs 21 having inwardly directed protuberances 22 engaging in mating dimples 23 in the glass neck. The arc tube is supported within the envelope by welding its inlead 5 to lead-in wire 14 and its inlead 6 to a frame rod 24 welded to lead-in 13. The frame extends to anchoring dimple 25 in the dome end of the jacket which it engages by an encircling clamp 26. A conductor 27 extending through the collar 17 connects lead-in wire 13 to the threaded shell 28 of the base which serves as the common or grounded side of the lamp. Another conductor 29 connects lead-in wire 14 to the central eyelet 31 of the base which serves as the "hot" side of the lamp.

The electronic starting aid or pulser consists of five principal active components mounted on an insulating board 32 which is located within mogul base 16 next to the glass web 33. A resistor R is connected in series with a capacitor C and a thermal switch S across the lamp voltage terminals, that is between shell 28 and eyelet 31 of the base, to form a charging circuit. A pulse transformer T, suitably a magnetic one having a ferrite core, or alternatively a piezoelectric one, has its primary connected in series with a voltage sensitive switching device G across capacitor C. A voltage sensitive switching device is one which suddenly converts from a high impedance state to a low impedance state when the voltage applied across it reaches a predetermined level known as the breakdown level: examples are spark gap devices and solid state switching devices such as four layer diodes. In the drawing, the switching device has been illustrated as a spark gap device. The secondary of the pulse transformer has one end connected to the spark gap and the other to lead-in wire 15 extending through stem 12 of the jacket at the other end. An external starting wire or probe 34 welded to lead-in wire 15 terminates close to the middle of the arc tube.

The lamp is operated by connecting it across the output terminals of a conventional current-regulating circuit for a device having a negative slope reactance. By way of example, one suitable device is the usual 175 watt CWA (constant wattage autotransformer) type ballast for a 175 watt metal halide lamp. As illustrated, the ballast comprises a primary winding 36 which is connected across alternating current line terminals 37,38, a secondary winding 39 connected into the primary through an autotransformer tap, and a series capacitor 40. The open circuit voltage from the ballast is about 300 volts RMS. Initially capacitor C charges through resistor R at every half cycle until the breakdown voltage of gap G is exceeded. Capacitor C thereupon suddenly discharges through the primary of pulse transformer T and a high voltage pulse is produced in the secondary. By way of example of circuit parameters, resistor R may be 20 kilohms; capacitor C, 0.05 microfarad; and the turns ratio of the pulse transformer may be 1:50. The output at probe 34 is in the form of a 4 kilovolt pulse with a duration of approximately 15 microseconds at every 16 milliseconds. The probe produces visible ionization through capacitive effect and the striking voltage is reduced. As soon as the arc tube starts, the output voltage from the ballast drops and the voltage to which capacitor C charges no longer exceeds the breakdown voltage of the gap. Thus the generation of high voltage pulses stops immediately.

Capacitor C is the part of the electronic pulsing circuit most subject to deterioration as a result of heat. The pulsing circuit is located within the base at the point furthest removed from the hot arc tube and is embedded in potting compound to assure good heat conductivity to the base shell. The base shell is of brass or aluminum and is in contact with the corresponding shell of the socket through which heat is conducted and radiated the exterior. Notwithstanding all these precautions, we have found that under these circumstances the capacitor dielectric will not last the life of the lamp which may be as much as 15,000 hours. An important feature of my invention which has overcome this problem is the provision of thermal switch S located in physical proximity to capacitor C and connected in series with resistance R and capacitor C across the lamp terminals. When the temperature within the base reaches approximately 75° C., the switch contacts open and thereafter prevent the application of lamp voltage across the capacitor. Even though the temperature of the capacitor is essentially no different under these circumstances, the absence of voltage across the dielectric will extend its life severalfold and make it fully adequate for the projected life of the lamp. In addition, opening the charging circuit to the capacitor eliminates the energy loss in the series resistor R which may be close to one watt. While the energy saving is minor, at today's prevailing energy rates the value thereof over the lamp's lifetime exceeds the incremental cost of the thermal switch.

What I claim as new and desire to secure by Letters Patent of the United States is:

1. A dual envelope high intensity discharge lamp comprising:

an outer vitreous jacket enclosing an inner arc tube having an electrode sealed into each end and containing an arc sustaining filling, a base fastened to an end of said jacket comprising a metal shell and an insulated end contact together with conductors extending from shell and end contact into said jacket to the electrodes of said arc tube, an electronic pulsing circuit in said base comprising a resistor and a capacitor serially connected between shell and end contact, a pulse transformer having a primary and a step-up secondary, and a voltage sensitive switch device, said transformer having its primary connected in series with the switch device across said capacitor, one side of the secondary being connected to a common point and the other being capacitively coupled to said arc tube, and said switch device having a breakdown voltage less than that to which said capacitor charges prior to ignition of the arc tube whereby said circuit produces high voltage pulses until the lamp starts, and a thermal switch in said base connected in series with said resistor and capacitor between shell and end contact, said switch opening when said base attains normal operating temperature whereby to remove voltage from said capacitor and extend its life.

2. A dual envelope lamp as in claim 1 wherein said voltage sensitive switch is a spark gap device.

3. A lamp as in claim 1 wherein said vitreous jacket has a three lead stem at one end through which conductors extend from shell and end contact of the base to the arc tube electrodes, and from the secondary of the pulse transformer to a probe terminating close to the arc tube.

* * * * *